United States Patent [19]

Aoki et al.

[11] 4,445,772

[45] May 1, 1984

[54] ELECTRONIC PHOTOGRAPHING DEVICE

[75] Inventors: Takao Aoki, Abiko; Takahiro Inoue, Yokohama, both of Japan

[73] Assignee: Canon Kabushiki Kaisha, Tokyo, Japan

[21] Appl. No.: 402,538

[22] Filed: Jul. 28, 1982

Related U.S. Application Data

[63] Continuation of Ser. No. 141,918, Apr. 21, 1980, abandoned.

[30] Foreign Application Priority Data

Apr. 27, 1979 [JP] Japan ..... 54-52413

[51] Int. Cl.[3] ..... G03G 15/02

[52] U.S. Cl. ..... 355/3 CH; 355/4; 355/14 CH; 361/235

[58] Field of Search ..... 355/3 R, 3 CH, 4, 14 CH; 361/229, 230, 235

[56] References Cited

U.S. PATENT DOCUMENTS 3,527,941 9/1970 Culhane et al. ..... 361/235 X
3,967,891 7/1976 Rippstein ..... 361/229 X
3,990,791 11/1976 Tsukada ..... 355/14 CH X
4,141,648 2/1979 Gaitten et al. ..... 355/3 CH X
4,165,165 8/1979 Iwami et al. ..... 355/4

*Primary Examiner*—Fred L. Braun
*Attorney, Agent, or Firm*—Fitzpatrick, Cella, Harper & Scinto

[57] ABSTRACT

An electrophotographic device wherein an image is formed by exposing a movable photosensitive member to an optical image, wherein such member includes a conductive layer, a photoconductive layer, and an insulating layer. A primary corona discharger of predetermined polarity charges the surface of such member and an imagewise exposure is effected through an optically open port in the rear side of a secondary corona discharger. A plural number of sets of control grids, adapted to be set at different electric potentials, are used in conjunction with the secondary charger which applies a corona discharge having an opposite polarity component to the primary corona. The control potential at the upstream grid has a value biased more toward the high light potential side of the latent image than toward the control potential of the adjacent grid.

10 Claims, 10 Drawing Figures

ELECTRONIC PHOTOGRAPHING DEVICE

This is a continuation of application Ser. No. 141,918, filed Apr. 21, 1980, now abandoned.

BACKGROUND OF THE INVENTION

1. Field of the Invention

This invention relates to an electronic photographing device, or more particularly, to an electronic photographing device wherein the tonal characteristic of electrostatic latent image formed on the light sensitive body is improved to obtain a fogless reproduced image.

2. Description of the Prior Art

The images formed by conventional electrophotography are difficult to conform to the originals and reproduction of original gradation is difficult due to the tone hardness of the electrostatic latent image characteristic of the light sensitive body which is mainly expressed by Do (original density) - Vs (surface potential of light sensitive body) characteristic.

Although the improvement of gradation is important in monochromatic reproduced images, it is very important in multi-color imaging for color reproduction and for keeping color balance.

The method described in Ser. No. 929,508 (June 27, 1978) proposed before this applicant is very effective because the method made it possible to reproduce original gradation faithfully by expanding the original density reproducible range of the Do−Vs characteristic.

However, if the configuration and condition of the original optical image exposure to a simultaneous de-electrifying means were inappropriate there were cases where multiples of electric power of the original illuminating lamp was required, compared with the case of ordinary optical image exposure to simultaneous de-electrification in which no control is made on the gradation. Moreover, the effect of gradation control was not sufficient.

Particularly in a color copying device, the above-mentioned increase in the power of the illuminating lamp is an important problem in performing color separation exposure, and in some cases where halogen lamps were used, yellow fogging was produced due to the shortage in the amount of light of blue component.

This invention was made to solve the above-mentioned problems.

SUMMARY OF THE INVENTION

An object of this invention is to provide a novel and effective electronic photographing device.

A further object of this invention is to provide a device capable of obtaining a fogless reproduced image by improving the gradation of electrostatic latent image formed on the light sensitive body.

Another object of this invention is to provide a multi-color electronic photographing device in which color balance is improved.

DESCRIPTION OF THE PREFERRED EMBODIMENTS

Figure 1:
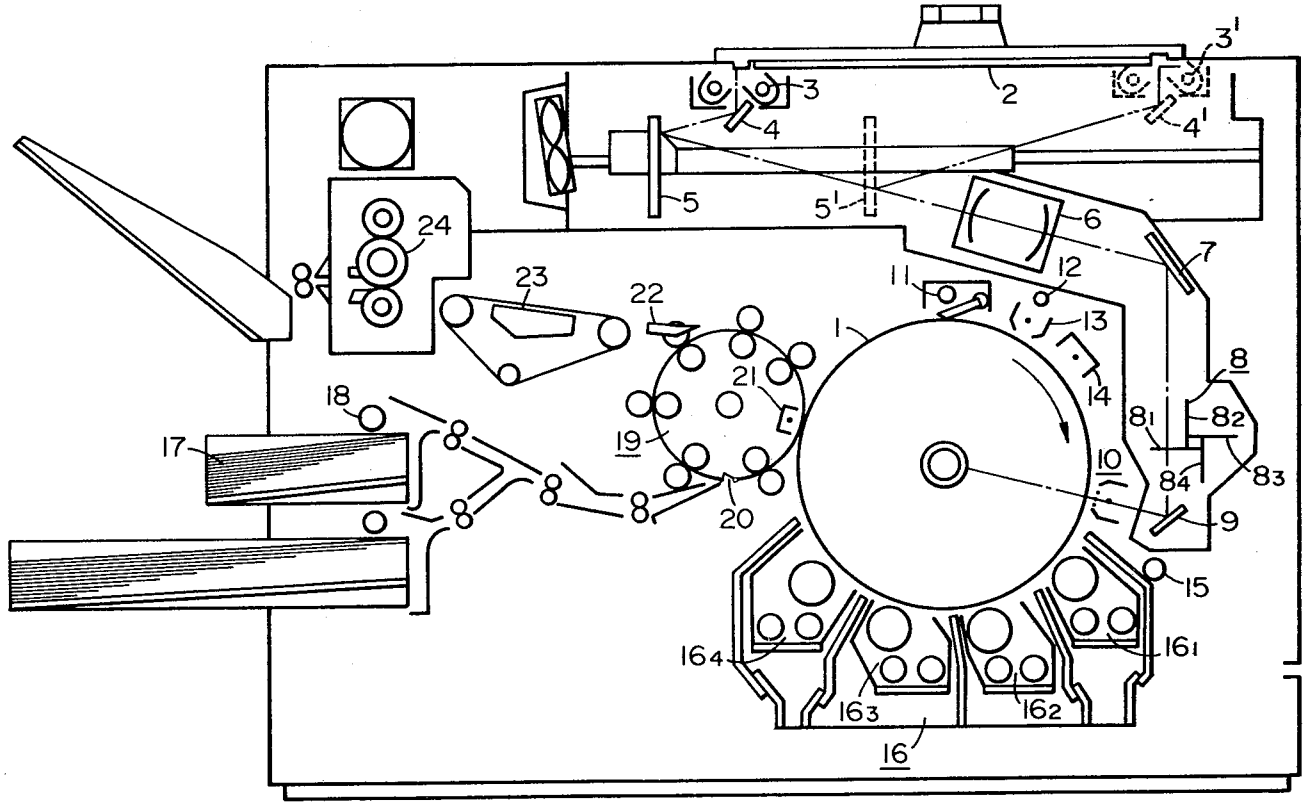
FIG. 1 is a side view showing an embodimental electronic photographic device based on this invention.

FIG. 1 is a side view of an embodimental electronic photographic device according to this invention. It is an example of a configuration which enables multi-color reproduction to be made.

The light sensitive body drum 1 is provided with a light sensitive body having as a fundamental configuration a conductive layer, a CdS photoconductive layer, and an insulating layer.

The original paper to be copied is placed on the original sheet table glass 2 and is illuminated by the illuminating lamp 3. The scanning mirrors 4 and 5 for scanning the original sheet scan the original sheet in synchronization with the rotation of the drum 1 and moves to the positions 4', 5'. At this time, the illuminating lamp 3 also moves to position 3'.

The optical image of the original scanned sheet is exposed to the surface of the light sensitive body by way of the lens 6, mirror 7, color separating means 8, and mirror 9 and further through exposure to a simultaneous de-electrifying device 10. The color separating means 8 is provided switchably so that either the blue filter $8_1$, or the green filter $8_2$, or the red filter $8_3$, or $ND8_4$ filter is used corresponding to each separated color.

On the other hand, the surface of the light sensitive body drum 1 is cleaned in advance by the blade cleaner 11 and then the effect of the latent image of the preceding time is removed by the preliminary exposure lamp 12 and the preliminary de-electrifying device 13. Further, the surface of the light sensitive body drum 1 is uniformly charged to a surface potential of approximately +1500V by the primary corona discharger 14, and then de-electrified by the exposure to a simultaneous de-electrifying device (or the secondary corona discharger) 10 which exposes the optical image of the original sheet and at the same time applies corona discharge having reverse polarity components to the primary corona discharge.

As will be described later in detail, the de-electrifying device 10 is optically open on the back and a de-electrifying potential control grid is placed at the opening on the side adjacent to the light sensitive drum 1 and a predetermined voltage is applied to the grid. Further, to the corona discharge wire of the de-electrifying device 10 a DC of −8.5kV is applied.

The surface potential of the light sensitive body drum 1 is regulated to about −150V by the de-electrifying device 10.

Next, an overall uniform exposure is made by the uniform exposure light source 15 and a highly contrasting electrostatic latent image is formed on the surface of the light sensitive body. The potential of the high light section of the latent image is −50 to −100V at this time, and that of the low light section is +350 to +500V.

Next, development is accomplished by a predetermined unit of developing device 16 having a plural number of developing units which supply each color developing agent, yellow agent $16_1$, magenta agent $16_2$, cyan $16_3$ and black $16_4$.

On the other hand, the transcribing material 17 which transcribes developed image is supplied to the transcribing unit 19 by the feed-out roller 18. The transcribing unit 19 which is provided with a gripper 20 holds the transcribing material 17 by gripping the end of the transcribing material. The transcribing material 17 receives corona discharge on the back from the transcription corona discharge 21 contained in the transcribing unit 19, and the developed image on the surface of the light sensitive body is transcribed.

In the case of monochromatic copying, the transcribing material 17 is immediately removed from the transcribing unit by the action of the separating claw 22.

On one hand, in the case of multi-color reproduction, the gripper 20 of the transcribing unit 19 is not open until the transcription of the developed images of 2 or 3 colors has ended, and the separating claw 21 holds the transcribing material without performing its operation. In either case, the transcribing material 17 after separation is led to the thermo-fixing roller 24 by the carrier belt 23, where the transcribed developed image is thermo-fixed. After the fixing is ended, the transcribing material is discharged onto the paper discharge tray. On the other hand, the toner that has remained on the surface of light sensitive body drum 1 after ending the transcription is cleaned with the blade cleaner 11 to be ready for the next copying cycle.

Figure 2A:
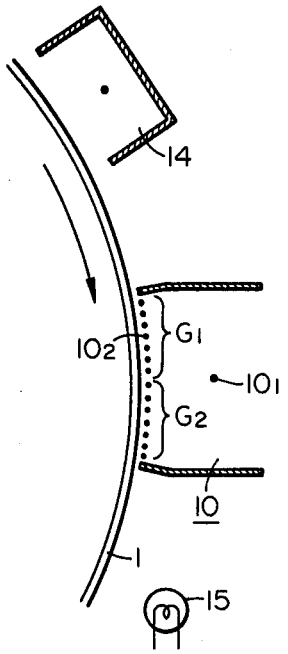
FIG. 2A is a magnified view of the de-electrifying device of the device shown in FIG. 1.

Next, the de-electrifying device 10 is used simultaneously with optical image exposure will be described in detail. FIG. 2A shows a magnified view of the part in which the grid wire $10_2$ runs perpendicular to the rotary direction of the drum. The intervals between the grid wires is selected appropriately within the range from 0.5 to 2 mm.

A DC voltage within a range of −50 to −300V is applied to the control grid G1 on the primary corona discharger 14 and an optimum voltage is selected corresponding to color separation exposure. Moreover, although the control grid G2 is fixed at ground potential (0V), an approximate +10 to +200V DC voltage is applied to it, depending on the cases. Although one or plural number of corona discharge wires are run parallel to the grid wire, explanation will be given here by assuming only one corona discharge wire for simplicity's sake.

In the example shown in the drawing, the corona discharge wire $10_1$ is placed approximately on the boundary of the control grids G1 and G2 which are run on the front panel of the exposure to a simultaneous de-electrifying device.

A high voltage in reverse polarity to that of the primary corona discharge 14 is applied to the discharge wire $10_1$. In the case where the impressed voltage is negative in polarity, non-uniform de-electrification tends to appear due to the non-uniform corona discharge when the impressed voltage is low and, to prevent this phenomenon, impression of a high voltage over −8.0kV is required. Compared with the case of ordinary corona charging where the impressed voltage is within the range of from −5.0kV to −7.0kV, a high voltage and high current are used.

De-electrification is first made by the corona that has passed the control grid G1 and then by the corona that has passed the control grid G2.

In this corona discharge, if the exposure distribution for light image exposure is biased toward the control grid G1 side, the potential of high light section can be controlled favorably.

Figure 2B:
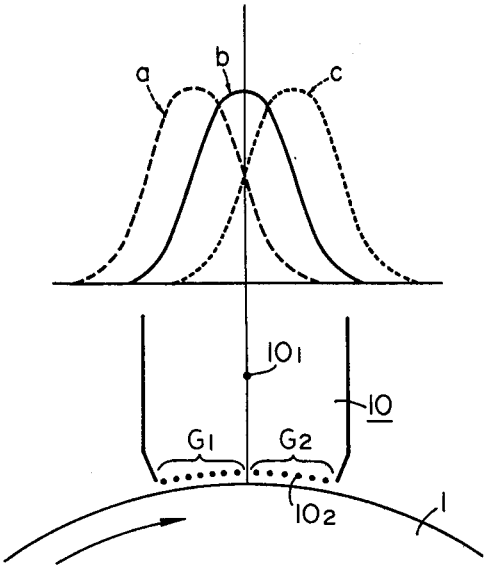
FIG. 2B is an explanatory drawing of exposure distribution of the optical image exposure to the de-electrifying device shown in FIG. 1.

FIG. 2B shows 3 different exposure (illumination) distributions of light image exposure incident to the opening section on the back of the de-electrifying device 10. The exposure distributions a, b and c are obtained by varying their relative positions to the center line (expressed by alternate long and short dash lines) which runs in the direction perpendicular to the discharge wire $10_1$ of the de-electrifying device 10, and the peak position of exposure distribution a (expressed by broken line) is within the range of the control grid G1, the peak position of b (continuous line) is at an intermediate position (or on the center line) between the control grids G1 and G2, and the peak position of (dotted line) is within the range of the control grid G2.

These exposure distributions are for the case of a white original sheet. In all cases, in the direction parallel to the discharge wire $10_1$, the exposure distributions are of approximately the same intensity.

A concrete method to vary the exposure distribution as mentioned above is, for example, to adjust the mounting position of the original sheet table exposure light source lamp. It is also accomplished by adjusting the mounting position of the reflection shade of the lamp. Further, a favorable adjustment can be obtained by adjusting the mounting position of both the lamp and the reflection shade.

Figure 3:
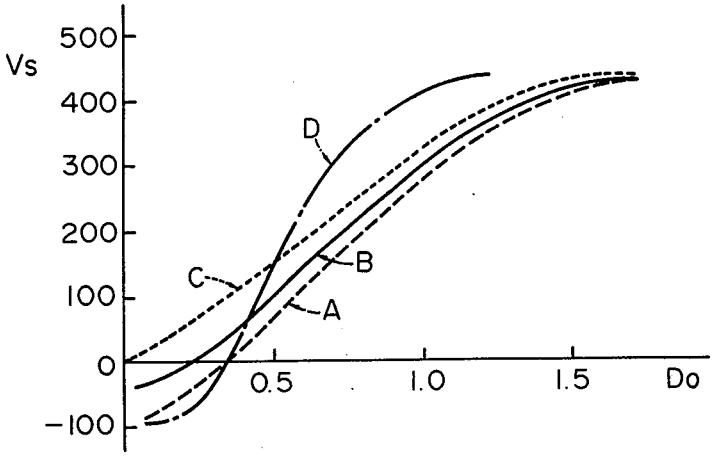
FIG. 3 shows a Do−Vs characteristic drawing of another exposure distribution on the de-electrifying device shown in FIG. 2B.

FIG. 3 shows in the curves A, B and C the Do−Vs characteristic in the relationship with the exposure distributions a, b and c against the discharge wire 10 of the de-electrifying device 10 shown in FIG. 2B (characteristic in the color separation exposure for blue). The same is applied to the characteristics of other color separation exposure or an ND filter exposure.

For comparison's purpose, the general Do−Vs characteristic in the conventional black and white copying device is shown with alternate long and short dash lines. Compared with the fact that the original density reproducing range of D is about 0.7, the reproducing ranges of A, B and C are all 1.2 or higher, showing that gradation has been extremely improved.

However, although there is no great difference in the original density reproducing range among A, B and C, if comparison is made between the original densities where the surface potential is 0V, a difference of 0.20 lies between B and C, and a difference of 0.12 between A and B.

This means that with the original density giving 0V in A an amount of exposure 1.32 times the exposure of the case of A is required in order to obtain 0V also in B and an amount of exposure 2.09 times the A is required to obtain 0V in C. In order to remove the fog on the background of the image, it is necessary to bring the surface potential of the high light section to below 0V, meaning that a large amount of exposure is required in B and C, especially in C compared with A.

Although the CdS light sensitive body used in FIG. 1 is highly sensitive compared with other light sensitive bodies, an illuminating lamp of 1 kV is used for reasons of performing exposure through the color separation filter and of performing high-speed copying. The use of a larger power illuminating lamp to increase the amount of exposure leads to the very difficult problems of greatly enlarging the device, increase in the heat generation, and increasing the power consumption.

Accordingly, in the cases of A and B, especially of A, exposure is possible with a small amount of exposure compared with the case of C without impairing actual gradation. In other words, sensitivity can be increased and the practical effect is extremely high.

Figure 4A:
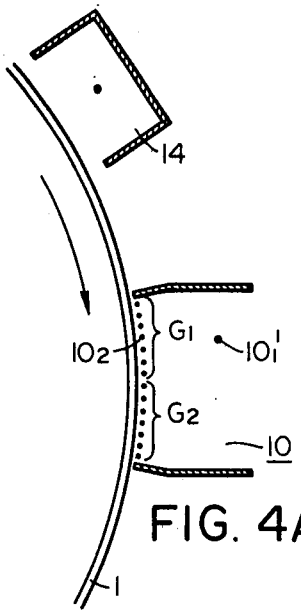
FIG. 4A is a magnified view of a modification of the de-electrifying device shown in FIG. 1.
Figure 4B:
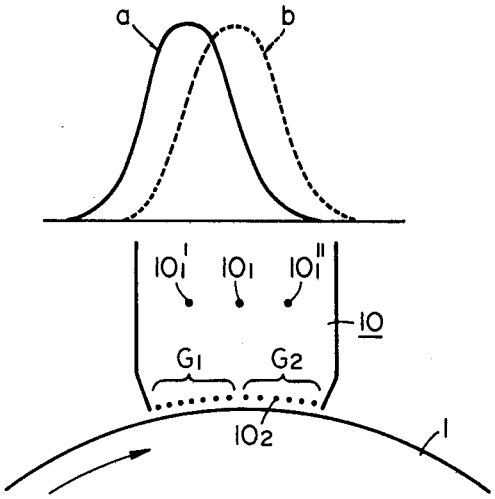
FIG. 4B is an explanatory drawing showing an example of changes in the position of the corona discharge wire of the de-electrifying device.

A more favorable gradation control can be made by positioning the corona discharge wire of the de-electrifying device 10 near the boundary of the control grids G1 and G2 or on the control grid G1 side. This is the position of the corona discharge wire $10_1$ shown in FIG. 2A and the position of the corona discharge wire $10_1'$ shown in FIG. 4A.

Figure 5:
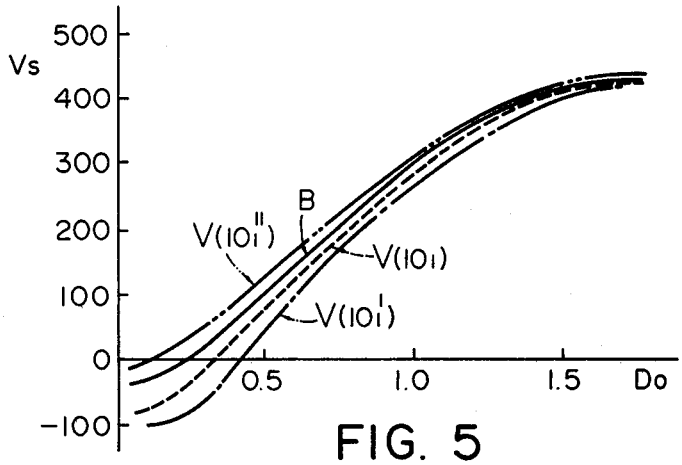
FIG. 5 is a Do−Vs characteristic drawing at each corona discharge wire position shown in FIG. 4B.

The change in Do−Vs characteristic (characteristic in blue color separation which applies also to the characteristics in other color separation exposures or an ND filter exposure) for the case where the discharge wire $10_1$ of the de-electrifying device 10 is moved either to position $10_1'$ or $10''$. FIG. 5 shows the Do−Vs characteristic for each case. The case in which the exposure distribution is B and the position of discharge wire is $10_1$ is shown as B for reference.

In the case of the curve $V(10_1')$ where the discharge wire position is $10_1'$, mainly the de-electrifying efficiency of high light section is extremely high and a highly sensitive latent image formation becomes possible compared with the curve $V(10'')$ where the discharge wire position is $10_1''$. What is to be noted here is that Do—Vs characteristic is not moving parallel $V(10_1'')\rightarrow V(10_1')\rightarrow V(10_1'')$, but the surface potential of the characteristic has a steep inclination at the high light section potential of about 0V or less. Accordingly, in the case of $V(10_1')$, actual gradation is not impaired as compared with the case of $V(10_1'')$ or $V(10_1)$ and the fogging of the image can be removed effectively. In other words, the sensitivity can be increased.

Further, when the discharge wire is at position $10_1'$ it is possible to reduce the voltage impressed on the discharge wire and also the discharge current, compared with the cases of $10_1$ and $10_1''$, especially $10_1''$. As a result, generation of undesirable ozone can be reduced as well as the capacity of high voltage power supply.

Also, the discharge wire of the de-electrifying device 10 of this embodiment has been explained as being a single wire, and the above-mentioned effect can be obtained even in the cases where a plural number of discharge wires are provided, if at least one of the wires are near the position 10'

Further, it is effective to control the bias voltage applied to the control grid G1 of FIG. 2 at the time of each color separation exposure and ND filter exposure.

Figure 6:
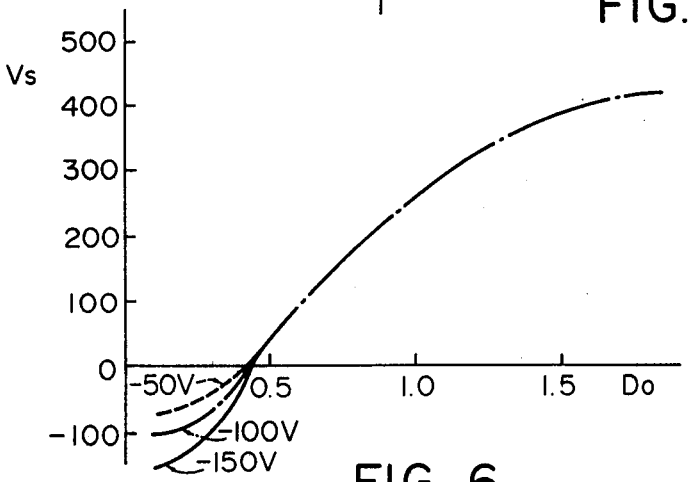
FIG. 6 shows Do−Vs characteristic drawing for the case where the voltage applied to the control grid G1 of the de-electrifying device is varied.

This is because there occurs a phenomenon at the time of optical image exposure to simultaneous de-electrification that, due to the effect of the space charge in the photoconductive layer, the potential of mainly the high light section among the Do−Vs characteristic varies with each color (when the low light sections of each color separation exposure characteristic is made uniform), and accordingly, in order to keep the Do−Vs characteristics for blue, green, and red uniform it is effective to impress an optimum bias voltage, which corresponds to the color separation optical image, on the above-mentioned G1. FIG. 6 shows the example of variation obtained when Do−Vs characteristic on the high light section is adjusted by varying the voltage impressed on the control grid G1. The figure for each graph shows the impressed voltage on the control grid for each case.

Figure 7A:
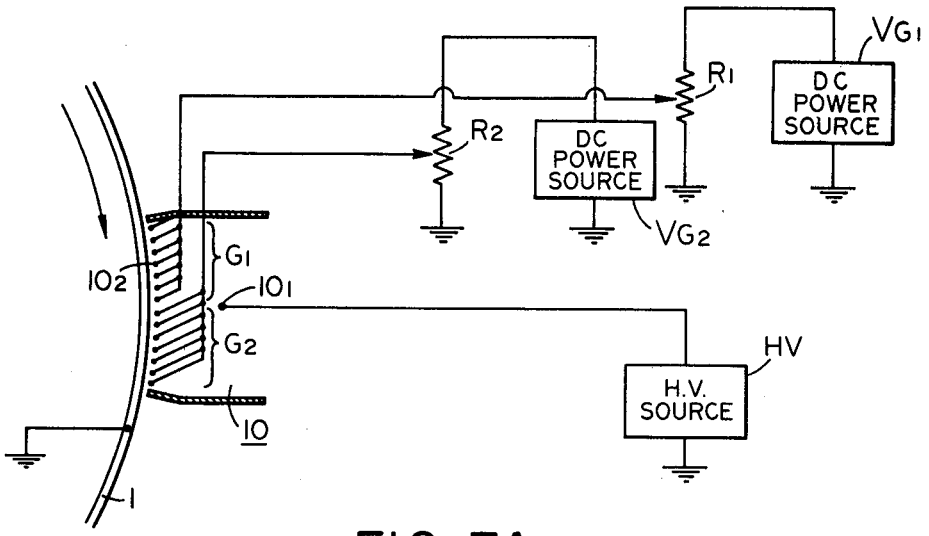
FIG. 7A is a typical circuit diagram to explain the power supply connected to the de-electrifying device of the device shown in FIG. 1.

FIG. 7A shows an example of connecting the power supply circuit to the corona discharge wire $10_1$ and control grids G1 and G2 in the de-electrifying device of the device shown in FIG. 1.

To the corona discharge wire $10_1$ is connected the high voltage power supply HV which provides a voltage having negative (−) polarity component (in other words, negative (−) polarity DC voltage, or AC voltage, or AC voltage biased to negative (−) polarity) in FIG. 1 a device in order to form a corona discharge which has the reverse polarity component from the primary discharge as mentioned above.

Figure 7B:
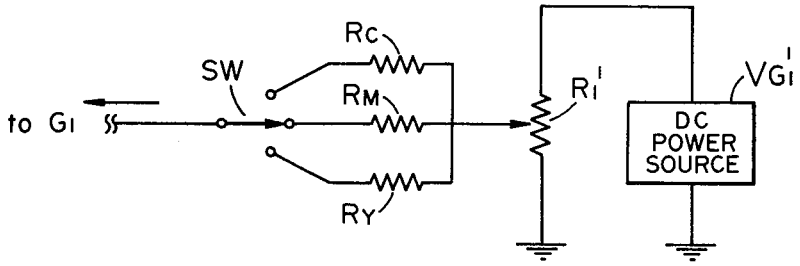
FIG. 7B is a typical circuit diagram showing a modified example of color reproduction.

The control grids G1 and G2 are respectively connected to DC power supplies VG1 and VG2 by way of variable resistors $R_1$ and $R_2$, and are maintained at predetermined potentials, respectively. To bring the control grid to ground potential, it is naturally sufficient to omit the DC power supply and ground the grid. FIG. 7B shows an example of concrete circuits of the case where the set potential of the first control grid G1 is varied for each color when forming a multi-colored image.

To the DC power supply VG1' and a variable resistor $R_1'$, which are similar to the case of above-mentioned FIG. 7A, resistors $R_C$, $R_M$ and $R_Y$ are arranged in parallel on the wire leading to the control grid G1, which can be changed over by the switch SW which is operated by the control circuit not shown in the drawing.

In the device shown in FIG. 1 good color balanced image could be obtained by applying voltages −200V, −150V, and −120V respectively at the time of blue, green and red color separation exposures. A clear image could be obtained in the case of ND filter exposure by applying a −150V voltage to G1.

As has been described in detail referring to the embodiment, the device according to this invention has made it possible to easily obtain good image gradation.

Moreover, since the device according to this invention makes it possible to perform the control of image gradation efficiently, the device is very useful in practical use.

Also, the device according to this invention is excellent because the device is capable of accomplishing good gradation reproduction not only in monochromatic reproduction but also in multi-colored reproduction.

What we claim is:

1. An electrophotographic process using a movable photosensitive member essentially consisting of a conductive layer, a photoconductive layer and an insulating layer, comprising the steps of:

applying a primary corona of a predetermined polarity onto said photosensitive member;

applying a second corona having a component of the polarity opposite to the predetermined polarity, wherein said second corona application includes a first step of discharging the photosensitive member to a predetermined level and a second step of adjusting the surface potential of the photosensitive member to a level equal to or lower than a predetermined intermediate level which is lower than the potential of said primary corona applying step but higher than the potential of said first step; and exposing said photosensitive member to image light having a peak of light intensity projected simultaneously with said first step and said second step.

2. An electrophotographic process for providing a multi-color image by exposing a photosensitive member to color components of image light and sequentially forming color component images, using a movable photosensitive member essentially consisting of a conductive layer, a photoconductive layer and an insulating layer comprising the steps of:

applying a primary corona of a predetermined polarity onto said photosensitive member;

applying a second corona having a component of the polarity opposite to the predetermined polarity, including a first step of discharging the photosensitive member to a predetermined level set in accordance with each of said color components and a second step of adjusting the surface potential of the photosensitive member to a level equal to or lower than a predetermined intermediate level which is lower than the potential of said primary corona applying step but higher than the potential of said first step; and exposing said photosensitive member to image light having a peak of light intensity projected simultaneously with said first step and said second step.

3. An electrophotographic apparatus, comprising:

a movable photosensitive member essentially consisting of a conductive layer, a photoconductive layer and an insulating layer;

a primary corona discharger for applying corona of a predetermined polarity onto said photosensitive member;

a secondary corona discharger for applying corona having a component of the polarity opposite to the predetermined polarity, said secondary corona discharger having first and second control grids arranged side by side and in a face-to-face relation with said photosensitive member, said first grid being positioned upstream in relation to said second grid with respect to the direction of movement of said photosensitive member and having a first bias voltage applied thereto, and said second grid having a second bias voltage applied thereto which is different from said first bias voltage, wherein said corona wire is aligned with said first control grid or aligned in an area between the first and second control grids, and said secondary corona discharger having an optical opening through which said photosensitive member is exposed to image light;

means for exposing said photosensitive member to image light through said optical opening so that a peak of light intensity distribution of the image light is aligned with the first control grid or with the area between said first control grid and said second control grid.

4. An electrophotographic apparatus, comprising:

a movable photosensitive member essentially consisting of a conductive layer, a photoconductive layer, and an insulating layer;

a primary corona discharger for applying corona of a predetermined polarity onto said photosensitive member;

a secondary corona discharger for applying corona having a component of the polarity opposite to the predetermined polarity, said secondary corona discharger including a first control grid and second control grid which are faced to said photosensitive member, said first grid being positioned upstream in relation to said second grid with respect to the direction of movement of said photosensitive member and having a first bias voltage applied thereto, and said second grid having a bias voltage applied thereto which is different from said first bias voltage, said secondary corona discharger having an optical opening through which said photosensitive member is exposed to image light;

means for exposing said photosensitive member to image light through said optical opening so that a peak of light intensity distribution of the image light is at the first control grid or at the area between said first control grid and said second control grid.

5. An apparatus according to claim 4, wherein said first grid is effective to discharge said photosensitive member more than said second grid.

6. An apparatus according to claim 4, wherein said apparatus comprises means for providing a multi-colored image, including means for exposing said photosensitive member to image light of different components, for sequentially forming different color component images.

7. An electrophotographic apparatus, comprising:

a movable photosensitive member essentially consisting of a conductive layer, a photoconductive layer and an insulating layer;

a primary corona discharger for applying corona of a predetermined polarity onto said photosensitive member;

a secondary corona discharger for applying corona having a component of the polarity opposite to the predetermined polarity, said secondary corona discharger including a first control grid and second control grid which are faced to said photosensitive member, said first grid being positioned upstream in relation to said second grid with respect to the direction of movement of said photosensitive member and having a first bias voltage applied thereto, and said second grid having a bias voltage applied thereto which is different from said first bias voltage, wherein said corona wire is aligned with the first control grid, or aligned with an area between the first control grid and the second control grid, and said secondary corona discharger having an optical opening through which said photosensitive member is exposed to image light; and means for exposing said photosensitive member to image light through said optical openings.

8. An apparatus according to claim 7, wherein said first grid is effective to discharge said photosensitive member more than said second grid.

9. An apparatus according to claim 7, wherein said apparatus comprises means for providing a multi-colored image, including means for exposing said photosensitive member to image light of different components, for sequentially forming different color component images.

10. An electrophotographic apparatus, comprising:

a movable photosensitive member essentially consisting of a conductive layer, a photoconductive layer, and an insulating layer;

a primary corona discharger for applying corona of a predetermined polarity onto said photosensitive member;

a secondary corona discharger for applying corona having a component of the polarity opposite to the predetermined polarity, said secondary corona discharger including a first control grid and second control grid which are faced to said photosensitive member, said first grid being positioned upstream in relation to said second grid with respect to the direction of movement of said photosensitive member and having a first bias voltage applied thereto, and said second grid having a bias voltage applied thereto which is different from said first bias voltage, wherein said first control grid is responsive to color constituents of the optical image to selectively control the potential, said secondary corona discharger having an optical opening through which said photosensitive member is exposed to image light; and means for exposing said photosensitive member to image light through said optical openings.

* * * * *

UNITED STATES PATENT AND TRADEMARK OFFICE

CERTIFICATE OF CORRECTION

PATENT NO. : 4,445,772

DATED : May 1, 1984

INVENTOR(S) : TAKAO AOKI, ET AL.

It is certified that error appears in the above-identified patent and that said Letters Patent is hereby corrected as shown below:

COLUMN 3

Line 40, after "of" insert --the--.

COLUMN 4

Line 28, after "position of" insert --c--.

COLUMN 6

Lines 19 and 20,"in FIG. 1 a device" should read --as ~~shown~~ shown in the FIG. 1 device,--.

Line 34, after "of" insert --the--.

Signed and Sealed this

Ninth Day of October 1984

[SEAL]

*Attest:*

*Attesting Officer*

GERALD J. MOSSINGHOFF

*Commissioner of Patents and Trademarks*